United States Patent [19]

Kaminaga

[11] Patent Number: 4,590,725

[45] Date of Patent: May 27, 1986

[54] SYSTEM FOR SEALING CROSS JOINT OF FOUR ADJACENT CURTAIN WALL UNITS

[75] Inventor: Hiromitsu Kaminaga, Kurobe, Japan

[73] Assignee: Yoshida Kogyo K. K., Tokyo, Japan

[21] Appl. No.: 603,281

[22] Filed: Apr. 23, 1984

[30] Foreign Application Priority Data

Apr. 26, 1983 [JP] Japan ..... 58-61462[U]
Apr. 26, 1983 [JP] Japan ..... 58-61463[U]

[51] Int. Cl.[4] ..... E04B 2/88; E04B 1/66

[52] U.S. Cl. ..... 52/235; 52/403; 52/731

[58] Field of Search ..... 52/235, 397–403, 52/730, 731; 49/DIG. 1, DIG. 2

[56] References Cited

U.S. PATENT DOCUMENTS

| | | | |
|---|---|---|---|
| 3,052,330 | 9/1962 | Hammitt et al. | 52/403 X |
| 3,466,826 | 9/1969 | Gallagher et al. | 52/235 X |
| 3,553,918 | 1/1971 | Dawson | 52/235 X |
| 3,940,897 | 3/1976 | Stoakes | 52/397 X |
| 3,956,863 | 5/1976 | Tiedeken | 52/399 |
| 4,214,415 | 7/1980 | Sukolics | 52/403 X |
| 4,458,745 | 7/1984 | Gartner | 285/191 X |

FOREIGN PATENT DOCUMENTS

| | | | |
|---|---|---|---|
| 3108355 | 9/1982 | Fed. Rep. of Germany | 52/235 |
| 56-165815 | 12/1981 | Japan . | |

*Primary Examiner*—John E. Murtagh
*Assistant Examiner*—Richard E. Chilcot, Jr.
*Attorney, Agent, or Firm*—Hill, Van Santen, Steadman & Simpson

[57] ABSTRACT

A sealing system for a curtain wall construction has a packing block of soft elastomeric material mounted at the cross joint betweeen four adjacent curtain wall units. At their one ends, first and second horizontal gaskets, each mounted between the upper and lower curtain wall units, are disposed against opposite sides of the packing block. First interior and exterior vertical gaskets are mounted between the two upper curtain wall units to define a first vertical space. The lower end of the first interior vertical gasket is disposed against the top of the packing block, while the lower end of the first exterior vertical gasket is spaced from the top of the packing block to define therebetween a drainage passage through which the vertical space opens to the exterior. Second interior and exterior vertical gaskets are mounted between the two lower curtain wall units to define a second vertical space. The upper ends of the second interior and exterior vertical gaskets are disposed against the bottom of the packing block.

1 Claim, 9 Drawing Figures

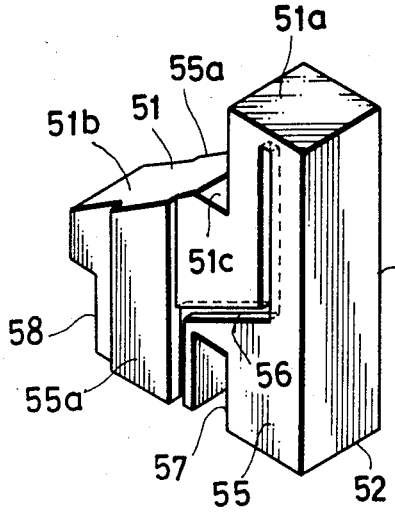
FIG. 4
FIG. 5
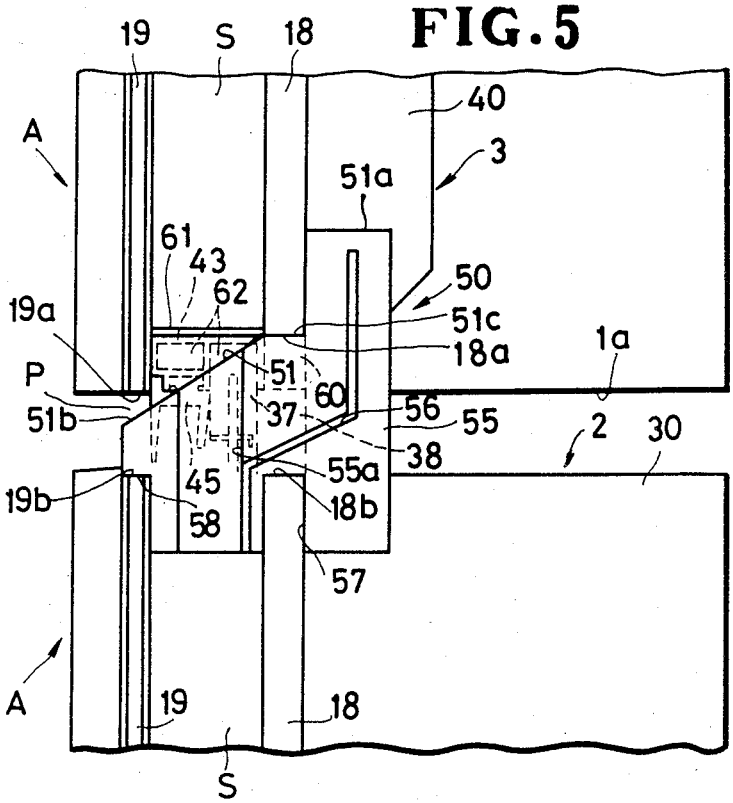

SYSTEM FOR SEALING CROSS JOINT OF FOUR ADJACENT CURTAIN WALL UNITS

BACKGROUND OF THE INVENTION

1. Field of the Invention

The present invention relates to a curtain wall construction composed of a plurality of curtain wall units arranged in rows and columns, and more particularly to a system for sealing the cross joint of four adjacent curtain wall units.

2. Description of the Prior Art

Attempts have been made to seal the joint between adjacent curtain wall units in a curtain wall construction composed of a plurality of curtain wall units arranged in a checkerboard pattern. To this end, the joint between an adjacent pair of vertically or horizontally opposed curtain wall units could be sealed relatively easily, but sealing at the corner or cross joint of four adjacent curtain wall units was very difficult.

Japanese Utility Model Laid-Open (Kokai) 56-165815 discloses a sealing system in which a cross-shaped resilient plate is mounted at the corner joint between four adjacent curtain wall units. However, with this prior system, adequate sealing is difficult to achieve.

SUMMARY OF THE INVENTION

According to the present invention, a sealing system has a packing block of soft elastomeric material mounted at the cross joint between four adjacent curtain wall units. At their one ends, first and second horizontal gaskets, each mounted betwen the upper and lower curtain wall units, are disposed against opposite sides of the packing block. First interior and exterior vertical gaskets are mounted between the two upper curtain wall units to define a first vertical space. The lower end of the first interior vertical gasket is disposed against the top of the packing block, while the lower end of the first exterior vertical gasket is spaced apart from the top of the packing block to define therebetween a drainage passage through which the vertical space opens to the exterior. Second interior and exterior vertical gaskets are mounted between the two lower curtain wall units to define a second vertical space. The upper ends of the second interior and exterior vertical gaskets are disposed against the bottom of the packing block.

It is therefore an object of the present invention to provide a system for sealing the cross joint between four adjacent curtain wall units with adequate watertightness.

Another object of the invention is to provide a sealing system for adjacent curtain wall units which enables the latter to be installed easily and accurately.

Many other objects, features and additional advantages of the present invention will become manifest to those versed in the art upon making reference to the detailed description and the accompanying sheets of drawings in which preferred structural embodiments incorporating the principles of the present invention are shown by may of illustrative example.

BRIEF DESCRIPTION OF THE DRAWINGS

FIG. 4 is an enlarged perpective view of a packing block of the sealing system;

FIG. 5 is an enlarged vertical cross-sectional view showing the packing block of FIG. 4 positioned at the cross joint between adjacent curtain wall units;

DETAILED DESCRIPTION

Figure 1:
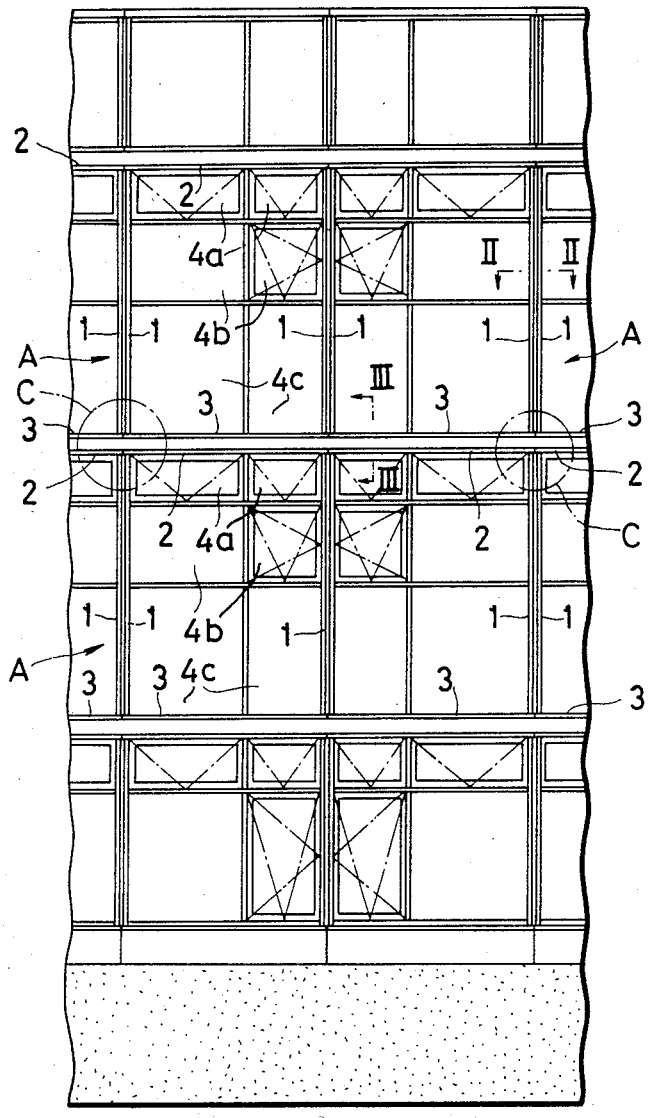
FIG. 1 is a fragmentary front elevational view of a curtain wall construction in which each cross joint between adjacent curtain wall units is sealed by a sealing system embodying the present invention.

FIG. 1 illustrates a curtain wall construction composed of a plurality of curtain wall units A mounted on a building in a checkerboard pattern. Each of the curtain wall units A comprises a pair of vertical frame members 1, 1 and a pair of upper and lower horizontal frame members 2, 3 joined with the vertical frame members 1, 1 end to end to provide a rectangular frame. This rectangular frame is divided, by a mullion and two transoms, into six smaller rectangles of different sizes to support two lights 4*a*, 4*a*, a fixed double-glazed panel 4*b*, a pivotable double-glazed panel 4*b*, and two insulating panels or glass panes 4*c*, 4*c*.

Figure 2:
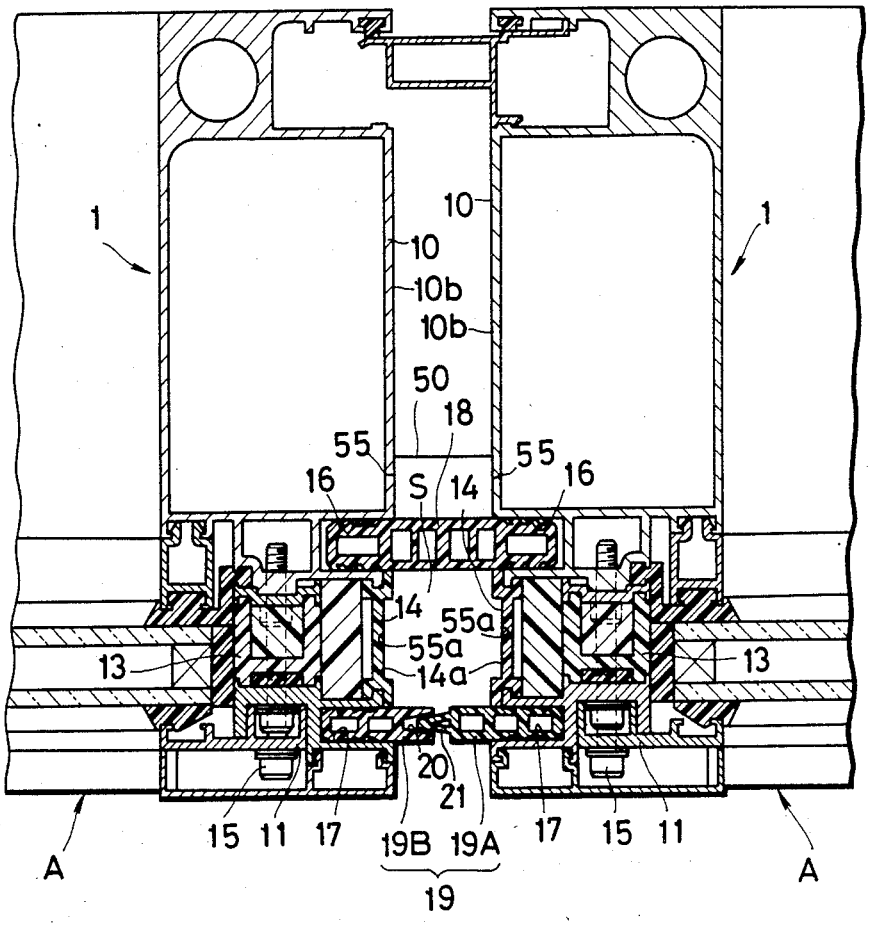
FIG. 2 is an enlarged horizontal cross-sectional view taken along line II—II of FIG. 1.

As shown in FIG. 2, each of the vertical frame members 1 includes a pair of interior and exterior parts 10, 11 interconnected by a screw 15, with a pair of first and second spacers 13, 14 of thermally insulating material sandwiched between the interior and exterior parts 10, 11. Each of the interior and exterior parts 10, 11 has along the entire length thereof a laterally opening vertical recess 16, 17.

A pair of parallel interior and exterior vertical gaskets 18, 19 is mounted between the adjacent vertical frame members 1, 1 so as to define therebetween a vertical space S. The interior vertical gasket 18 has opposite edge portions fitted respectively in the opposed vertical recesses 16, 16 in the interior parts 10, 10 of the adjacent vertical frame members 1, 1. The exterior vertical gasket 19 is composed of a pair of interfitting male and female halves 19A, 19B. The male gasket half 19A has a base fitted in the recess 17 of one of the opposed exterior parts 11 and has along its free edge a longitudinal tongue 21. The female gasket half 19B has a base fitted in the recess 17 of the other of the opposed exterior parts 11 and has along its free edge a longitudinal groove 20 receiving the tongue 21 of the male gasket half 19A. Thus the interior and exterior vertical gaskets 18, 19 jointly serve to seal the joint of an adjacent pair of horizontally opposed curtain wall units A, A.

Figure 3:
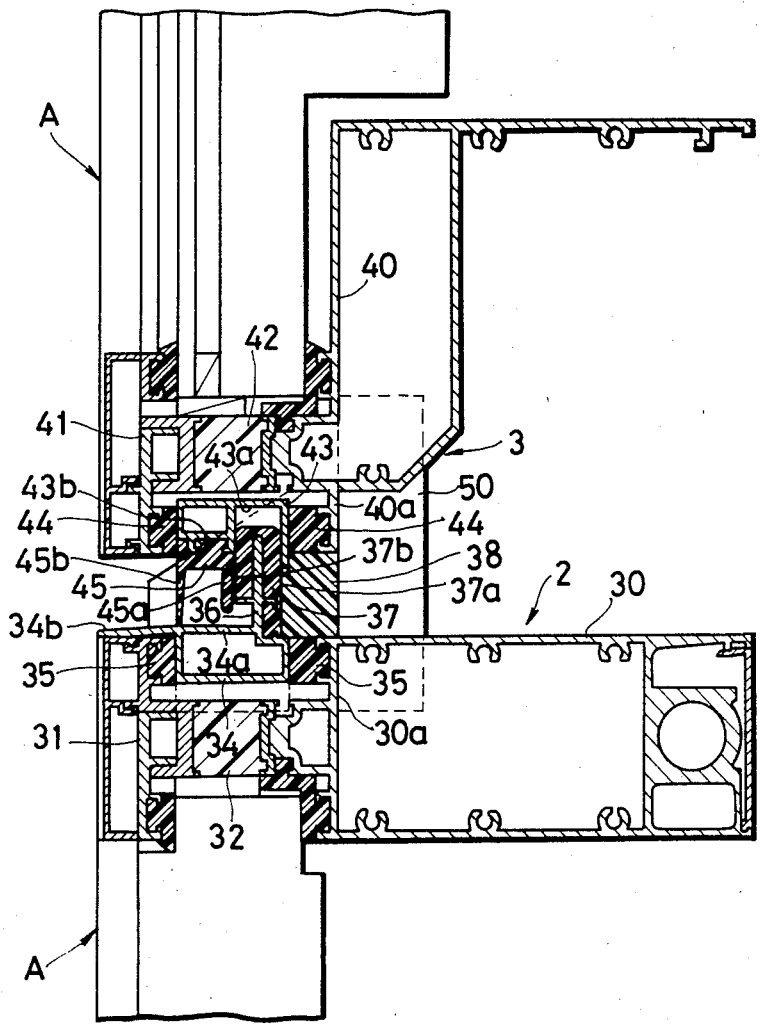
FIG. 3 is an enlarged vertical cross-sectional view taken along line III—III of FIG. 1.

As shown in FIG. 3, the upper horizontal frame member 2 includes a pair of interior and exterior parts 30, 31 interconnected by a thermally insulating connector 32. A first intermediate part 34 is sandwiched between a pair of thermally insulating strips 35, 35 carried by the interior and exterior parts 30, 31, respectively. The first intermediate part 34 is secured to an exterior wall 30*a* of the interior part 30 by a suitable means (not shown). The first intermediate part 34 has a horizontal upper wall 34*a* from which a slightly sloping throat 34*b*

(for preventing rainwater from running back into the curtain wall) extends exteriorly and from which an upright projection 36 extends. A horizontal gasket 37 is mounted on and along the upright projection 36, and an interior packing 38 is disposed against the interior side 37*a* of the horizontal gasket 37. Both the horizontal gasket 37 and the interior packing 38 are made of soft elastomeric material.

Likewise, the lower horizontal frame member 3 of the wall unit thereabove includes a pair of interior and exterior parts 40, 41 interconnected by a second thermally insulating connector 42. A second intermediate part 43 is sandwiched between at pair of thermally insulating strips 44, 44 carried by the interior and exterior parts 40, 41, respectively. The second intermediate part 43 is secured to a downwardly directed projection 40*a* of the interior part 40 by a suitable means (not shown). The second intermediate part 43 has a downwardly opening recess 43*a* in which the horizontal gasket 37 (carried by the first intermediate part 34) is fittingly received. An exterior packing strip 45 is carried on the under side 43*b* of the second intermediate part 43. The exterior packing strip 45 has a first lip 45*a* disposed against the exterior side 37*b* of the horizontal gasket 37, and a second lip 45*b* touching the throat 34*b* of the first intermediate part 34, thus sealing the joint of an adjacent pair of vertically opposed curtain wall units A, A.

Partly because the horizontal gasket 37 carried by the first intermediate part 34 is vertically movable in the recess 43*a* of the second intermediate part 43, and partly because the interior packing 38 is made of soft elastomeric material, it is possible to absorb a change of the distance between the adjacent upper and lower curtain wall units A, A.

Figure 6:
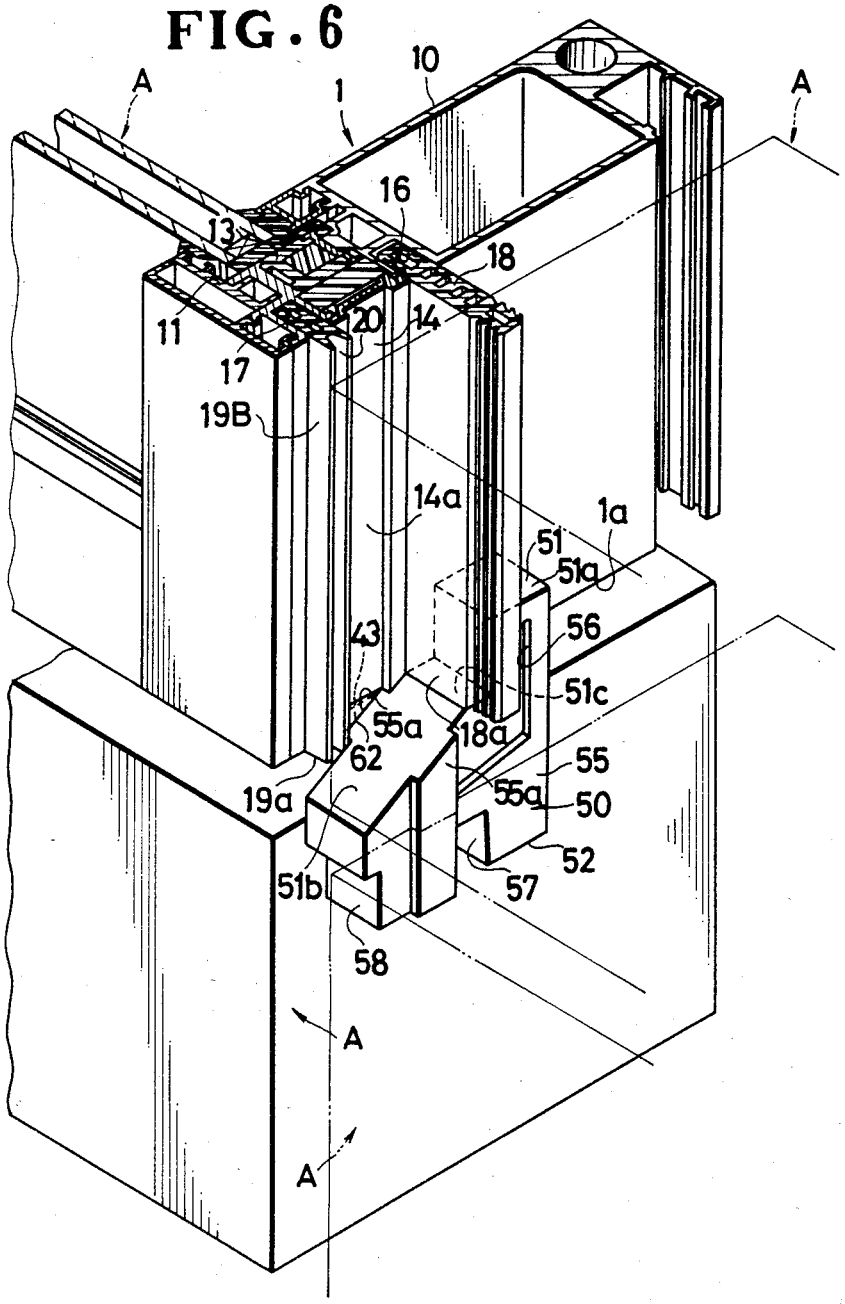
FIG. 6 is a perspective view corresponding to FIG. 5.

As shown in FIGS. 3, 5 and 6, a packing block 50 is disposed at the cross or corner C (FIG. 1) between four adjacent curtain wall units A. The packing block 50 (also shown in FIG. 4) is made of soft elastomeric material, and has a stepped top 51 constituted by a raised interior position 51*a*, a sloping exterior portion 51*b* and a flat intermediate portion 51*c*. At its bottom 52, the packing block 50 has an recess 57 and a cutout 58 which are vertically aligned with the intermediate portion 51*c* and the sloping exterior portion 51*b*, respectively. The packing block 50 also has a pair of lateral lands 55*a*, 55*a* on opposite sides, each land 55*a* being disposed between the transverse recess 57 and the cutout 58 and extending vertically between the bottom 52 and the sloping exterior portion 51*b*. Further, in each side 55 of the packing block 50, there is a generally crank-shaped channel 56.

The packing block 50 is mounted between four adjacent curtain wall units A in such a manner that each of the opposite sides 55 of the packing block 50 contacts both one of the vertical frame members 1 of the upper curtain wall unit A and the corresponding vertical frame member 1 of the lower curtain wall unit A. Each lateral land 55*a* of the packing block 50 is snugly received in both a recess 14*a* (FIGS. 2 and 6) of the second spacer 14 carried by the upper curtain wall unit's vertical frame member 1 and a recess 14*a* of the correspopnding second spacer 14 carried by the lower curtain wall unit's vertical frame member 1.

As shown in FIGS. 3 and 4, at their one end, all of the horizontal gasket 37, the interior packing 38 and the exterior packing strip 45 (that are disposed between the upper and lower horizontal frame members 3, 2 of an adjacent pair of lower and upper curtain wall units A, A) are disposed against the corresponding one of the opposite sides 55 of the packing block 50. The first and second intermediate parts 34, 43 of the opposed lower and upper horizontal frame members 2, 3 coextend with the horizontal gasket 37, the interior packing 38 and the exterior packing strip 45; that is, at its one end each of the first and second intermediate parts 34, 43 is also disposed against one side 55 of the packing block 50.

As shown in FIGS. 5 and 6, the lower end 18*a* of the interior vertical gasket 18, mounted between an adjacent pair of upper curtain wall units A, A, is disposed against the flat intermediate portion 51*c* of the top 51 of the packing block 50. At its lower end 19*a*, the corresponding exterior vertical gasket 19 extends toward and terminates short of the sloping exterior portion 51*b* of the packing block's top 51 to provide therebetween a drainage passage P through which the vertical space S opens to the exterior.

At their upper ends 18*b*, 19*b* (FIG. 5), the interior and exterior vertical gaskets 18, 19, mounted between an adjacent pair of lower curtain wall units A, A, are disposed against the bottom 52 of the packing block 50. Such upper end portions of the interior and exterior vertical gaskets 18, 19 are snugly received in the vertical recess 57 and the cutout 58, respectively.

Each crank-shaped channel 56 of the packing block 50 serves to allow any rainwater between one side 55 of the packing block 50 and an outer wall 10*b* (FIG. 2) of the adjacent vertical frame member's interior part 10, to run downwardly to the vertical space S, from which the rainwater is then discharged to the exterior via the drainage passage P (disposed at the lower end of the same vertical space S).

The lower end 18*a* of the interior gasket 18 is disposed above the lower end 1*a* (FIGS. 5 and 6) of the vertical frame member 1, while the lower end 19*a* of the exterior vertical gasket 19 is level with the lower end 1*a* of the vertical frame member 1. The lower end portion of the vertical recess 16 in the vertical frame member's interior part 10 is filled with a caulking material 60. The space between the second thermally insulating connector 42 and the second intermediate part 43 of the lower horizontal frame member 3 is also filled with a caulking material 61. In addition, opposite ends of the lower horizontal frame member's second intermediate part 43 are sealed with a packing or caulking material 62.

Thus the cross joint C between four adjacent curtain wall units A is sealed with adequate watertightness. In the curtain wall construction thus constructed, any rainwater which may have entered the vertical space S between the interior and exterior vertical gaskets 18, 19 would run down over the sloping exterior portion 51*a* of the packing block 50 and then would be immediately discharged to the exterior via the drainage passage P.

For assembly, the packing block 50 is mounted on the upper ends 18*b*, 19*b* of the interior and exterior vertical packing gaskets 18, 19 between an adjacent pair of lower curtain wall units A, A. Then an adjacent pair of upper curtain wall units A, A is installed over the two lower curtain wall units A, A, thus avoiding applying any liquid sealing material which step would be laborious and time-consuming and which would need to be carried out by well-experienced workmen under good weather conditions.

According to the present sealing system, adequate sealing at the cross joint of four adjacent curtain wall units can be achieved. Further, the curtain wall units can be installed with maximum ease even by less-experienced workmen.

Figure 7:
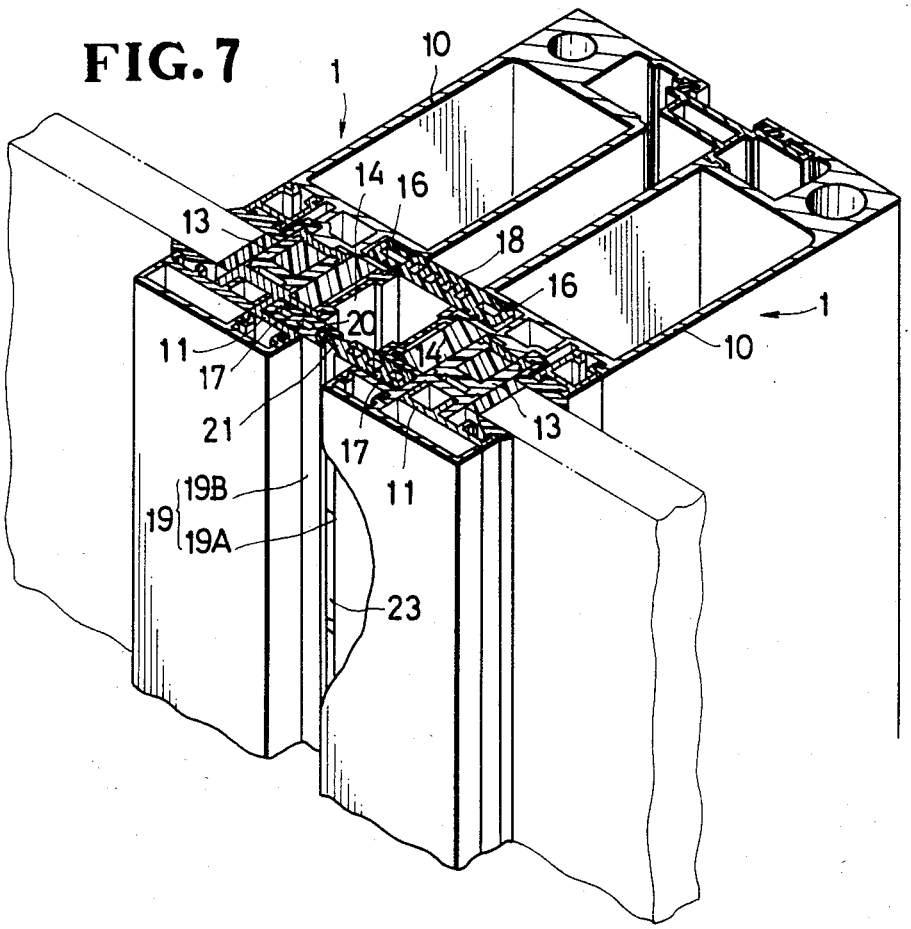
FIG. 7 is a perspective view similar to FIG. 6, showing a modified sealing system between horizontally opposed adjacent curtain wall units.
Figure 8:
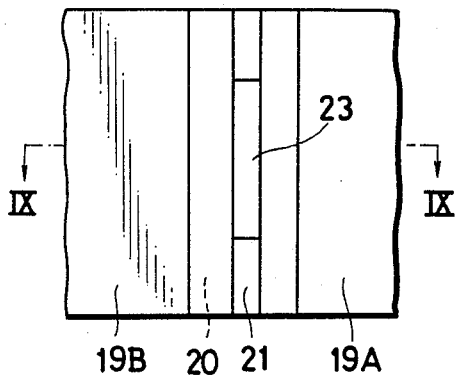
FIG. 8 is an enlarged fragmentary front elevational veiw of an exterior vertical gasket of the modified sealing system of FIG. 7.
Figure 9:
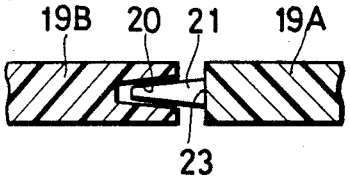
FIG. 9 is a horizontal cross-sectional view taken along line IX—IX of FIG. 8

FIGS. 7, 8 and 9 illustrate a modified form of the sealing system, in which the exterior vertical gasket 19 has an opening 23 through which the vertical space S between the interior and exterior vertical gaskets 18, 19 opens to the exterior, the opening 23 being in the form of a cutout in the tongue 21 of the male gasket half 19A. Because of this opening 23, the air pressure within the vertical space S remains equal to the air pressure of the exterior, thus guaranteeing adequate sealing even in heavy wind.

Although various minor modifications may be suggested by those versed in the art, it should be understood that I wish to embody within the scope of the patent warranted hereon, all such embodiments as reasonably and properly come with in the scope of my contribution to the art.

What is claimed is:

1. A system for sealing a cross joint of a curtain wall construction including a plurality of curtain wall units arranged in a checkerboard pattern, comprising;

(a) a packing block adapted to be disposed at the cross joint between four adjacent curtain wall units;

(b) a pair of spaced first interior and exterior vertical gaskets adapted to be mounted between a pair of horizontally aligned first and second ones of the four adjacent curtain wall units to define therebetween a first vertical space, said first interior vertical gasket having a lower end disposed against a top of said packing block, said first exterior vertical gasket having a lower end spaced apart from said top of said packing block to define therebetween a drainage passage through which said first vertical space opens to the exterior;

(c) a pair of spaced second interior and exterior vertical gaskets adapted to be mounted between a pair of horizontally aligned third and fourth ones of the four adjacent curtain wall units to define therebetween a second vertical space, each of said second interior and exterior vertical gaskets having an upper end disposed against a bottom of said packing block; and (d) said packing block having in each of its opposite sides a generally crank-shaped channel opening into said second vertical space.

* * * * *